US005093308A

United States Patent [19]

Sens et al.

[11] Patent Number: 5,093,308

[45] Date of Patent: Mar. 3, 1992

[54] OXADIAZOLYL-BENZENE AZO HYDROXY-PYRIDONE DYES FOR THERMAL TRANSFER PRINTING A YELLOW PRINT

[75] Inventors: Ruediger Sens, Mannheim; Gunther Lamm, Hassloch; Karl-Heinz Etzbach, Frankenthal, all of Fed. Rep. of Germany

[73] Assignee: BASF Aktiengesellschaft, Ludwigshafen, Fed. Rep. of Germany

[21] Appl. No.: 590,130

[22] Filed: Sep. 28, 1990

[30] Foreign Application Priority Data

Sep. 29, 1989 [DE] Fed. Rep. of Germany ..... 3932523

[51] Int. Cl.[5] ..... B41M 5/38; D06P 5/13

[52] U.S. Cl. ..... 503/227; 428/195; 428/412; 428/480; 428/913; 428/914; 8/471; 534/770; 534/775

[58] Field of Search ..... 8/471; 503/227

[56] References Cited

U.S. PATENT DOCUMENTS

| | | | |
|---|---|---|---|
| 4,555,427 | 11/1985 | Kawasaki et al. | 428/195 |
| 4,632,983 | 12/1986 | Lamm | 8/690 |
| 4,731,091 | 3/1988 | Majima | 8/471 |
| 4,764,178 | 8/1988 | Gregory et al. | 8/471 |
| 4,808,568 | 2/1989 | Gregory et al. | 503/227 |
| 4,820,687 | 4/1989 | Kawasaki et al. | 503/227 |
| 4,824,437 | 4/1989 | Gregory | 8/471 |
| 4,824,822 | 4/1989 | Yamamoto et al. | 503/201 |
| 4,892,859 | 1/1990 | Gregory et al. | 503/227 |
| 4,898,850 | 2/1990 | Igata et al. | 503/227 |
| 4,927,666 | 5/1990 | Kawasaki et al. | 427/146 |
| 4,985,395 | 1/1991 | Van Maele et al. | 503/227 |
| 4,985,396 | 1/1991 | Kawakami et al. | 503/227 |
| 4,985,397 | 1/1991 | Uemura et al. | 503/227 |
| 4,985,398 | 1/1991 | Beck et al. | 503/227 |

FOREIGN PATENT DOCUMENTS

| | | |
|---|---|---|
| 133011 | 2/1985 | European Pat. Off. . |
| 133012 | 2/1985 | European Pat. Off. . |
| 0216483 | 1/1987 | European Pat. Off. . |
| 227094 | 7/1987 | European Pat. Off. . |
| 247737 | 12/1987 | European Pat. Off. . |
| 0301752 | 1/1989 | European Pat. Off. . |
| 0319234 | 7/1989 | European Pat. Off. . |
| 152563 | 8/1985 | Japan . |
| 12393 | 1/1986 | Japan . |
| 61-199997A | 9/1986 | Japan . |
| 244595 | 10/1986 | Japan . |
| 262191 | 11/1986 | Japan . |
| 61-283595A | 12/1986 | Japan . |

OTHER PUBLICATIONS

C. E. Vellins in "The Chemistry of Synthetic Dyes," vol. VIII, (Academic Press), 1978, pp. 191–192.

Patent Abstracts of Japan vol. 11, No. 125 (M-582) (2572) 18 Apr. 1987, & JP-A-61 268494 (Dainippon Printing Co. Ltd.) 27 Nov. 1986.

Patent Abstracts of Japan vol. 10, No. 159 (M-486) (2215) 7 Jun. 1986, & JP-A-61 12392 (Mitsui Toatsu Kagaku K.K.) 20 Jan. 1986.

*Primary Examiner*—A. Lionel Clingman

*Attorney, Agent, or Firm*—Oblon, Spivak, McClelland, Maier & Neustadt

[57] ABSTRACT

Azo dyes useful for thermotransfer printing have the formula

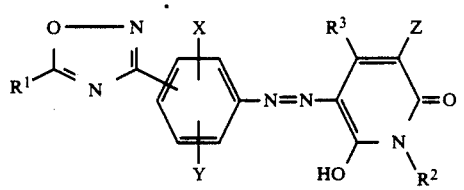

I where $R^1$ and $R^2$ are each H; alkyl, alkoxyalkyl, alkanoyloxyalkyl, alkoxycarbonyloxyalkyl, alkoxycarbonylalkyl, haloalkyl, hydroxyalkyl or cyanoalkyl each of up to 20 carbon atoms and each of which may be substituted by phenyl, $C_1$–$C_4$-alkylphenyl, $C_1$–$C_4$-alkoxyphenyl, halophenyl, benzyloxy, $C_1$–$C_4$-alkylbenzyloxy, $C_1$–$C_4$-alkoxybenzyloxy, halobenzyloxy, halogen, hydroxyl or cyano; phenyl or cyclohexyl which may each be substituted by $C_1$–$C_{15}$-alkyl, $C_1$–$C_{15}$-alkoxy, halogen or benzyloxy; or a radical II $$[-W-O]_n-R^4 \qquad \text{II}$$

where W is identical or different $C_2$–$C_5$-alkylene, n is 1–6, $R^4$ is $C_1$–$C_4$-alkyl or phenyl which may be substituted by $C_1$–$C_4$-alkyl or $C_1$–$C_4$-alkoxy, $R^3$ is H, $NH_2$, OH or $C_1$–$C_3$-alkyl, X is H, Cl, Br, $No_2$, methyl, phenoxy, tolyloxy, dimethylphenyloxy, chlorophenoxy or $C_1$–$C_4$-alkoxy, Y is H, Cl or Br, and Z is H, acetyl, carbamoyl or cyano.

4 Claims, No Drawings

OXADIAZOLYL-BENZENE AZO HYDROXY-PYRIDONE DYES FOR THERMAL TRANSFER PRINTING A YELLOW PRINT

The present invention relates to a process for thermotransfer printing wherein the transfer dye is an azo dye of the general formula I

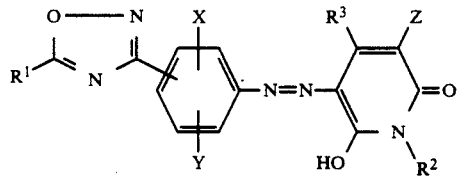

I in which the substituents have the following meanings:

$R^1$ and $R^2$ are each hydrogen;

alkyl, alkoxyalkyl, alkanoyloxyalkyl, alkoxycarbonyloxyalkyl, alkoxycarbonylalkyl, haloalkyl, hydroxyalkyl or cyanoalkyl, which may each contain up to 20 carbon atoms and be substituted by phenyl, $C_1$–$C_4$-alkylphenyl, $C_1$–$C_4$-alkoxyphenyl, halophenyl, benzyloxy, $C_1$–$C_4$-alkylbenzyloxy, $C_1$–$C_4$-alkoxybenzyloxy, halobenzyloxy, halogen, hydroxyl or cyano;

phenyl or cyclohexyl, which may each be substituted by $C_1$–$C_{15}$-alkyl, $C_1$–$C_{15}$-alkoxy, halogen or benzyloxy; or a radical of the general formula II $$[-W-O]_n-R^4 \qquad \text{II}$$

where

W is identical or different $C_2$–$C_6$-alkylene, n is from 1 to 6 and $R^4$ is $C_1$–$C_4$-alkyl or phenyl which may each be substituted by $C_1$–$C_4$-alkyl or $C_1$–$C_4$-alkoxy;

$R^3$ is hydrogen, amino, hydroxyl or alkyl;

X is hydrogen, chlorine, bromine, nitro, methyl, phenoxy, tolyloxy, dimethylphenyloxy, chlorophenoxy or $C_1$–$C_4$-alkoxy;

Y is hydrogen, chlorine or bromine; and

Z is hydrogen, acetyl, carbamoyl or cyano;

and also specifically to a process for transferring this azo dye by diffusion from a transfer to a plastic-coated sheet of paper with the aid of a thermal printing head.

The technique of thermotransfer printing is common knowledge; suitable heat sources besides lasers and IR lamps are in particular thermal printing heads capable of emitting short heat pulses lasting fractions of a second.

In this preferred embodiment of thermotransfer printing, a transfer sheet which contains the transfer dye together with one or more binders, a substrate material and possibly further assistants such as release agents or crystallization inhibitors is heated from the back with the thermal printing head, causing the dye to migrate out of the transfer sheet and to diffuse into the surface coating of a receiving medium, for example into the plastic coat of a coated sheet of paper.

The essential advantage of this process is that the amount of dye to be transferred (and hence the color gradation) can be controlled in a specific manner by adjusting the energy supplied to the thermal printing head.

Thermotransfer printing is in general carried out using the three subtractive primaries yellow, magenta and cyan (with or without black), and the dyes used must have the following properties to ensure optimal color recording: ready thermal transferability, little tendency to migrate within or out of the surface coating of the receiving medium at room temperature, high thermal and photochemical stability and also resistance to moisture and chemicals, no tendency to crystallize on storage of the transfer sheet, a suitable hue for subtractive color mixing, a high molar absorption coefficient, and ready industrial availability.

It is very difficult to meet all these requirements at one and the same time. In particular, the yellow dyes used to date have been unconvincing. This is also true of the azopyridones described and recommended for thermotransfer printing in EP-A-247 737, JP-A-12 393/1986, JP-A-152 563/1985, JP-A-152 563/1985, JP-A-262 191/1986 and JP-A-244 595/1986, which are similar to the compounds I but do not carry an oxathiazole radical on the phenyl ring, which may be unsubstituted or substituted.

The azo dyes I are themselves known per se or obtainable by known methods (EP-B-111 236).

It is an object of the present invention to find suitable yellow dyes for thermotransfer printing which come closer to the required property profile than the prior art dyes.

We have found that this object is achieved by the azo dyes of the formula I defined at the beginning.

We have also found a process for transferring azo dyes from a transfer to a plastic-coated medium by diffusion with the aid of a thermal printing head, which comprises using for this purpose a transfer on which there is or are situated one or more of the azo dyes I defined at the beginning.

We have further found preferred embodiments of this process, which comprise using dyes of the formula Ia

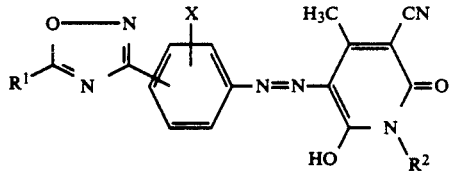

Ia having the above-defined meanings of substituents $R^1$, $R^2$ and X and dyes of the formula Ib

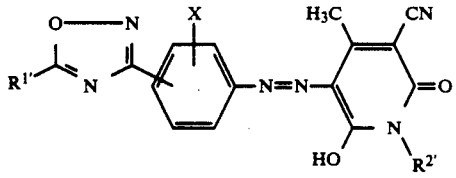

Ib where

X is as defined at the beginning and $R^{1'}$ and $R^{2'}$ are each:

hydrogen;

alkyl, alkoxyalkyl, alkanoyloxy or alkoxycarbonylalkyl, which may each contain up to 15 carbon atoms and be substituted by phenyl, $C_1$–$C_4$-alkylphenyl, $C_1$–$C_4$-alkoxyphenyl, hydroxyl or cyano; or a radical of the general formula III $$[-(CH_2)_3-O]_p-[(CH_2)_2-O]_q-R^{4'} \quad \text{III}$$

where p is 0 or 1, q is from 1 from 4, and $R^{4'}$ is $C_1$–$C_4$-alkyl or phenyl.

$R^1$ and $R^2$ are each preferably alkyl: methyl, ethyl, propyl, isopropyl, butyl, isobutyl, sec-butyl, tert-butyl, pentyl, isopentyl, sec-pentyl, tert-pentyl, hexyl, 2-methylpentyl, heptyl, octyl, 2-ethylhexyl, the isooctyl isomer mixture, nonyl, decyl, the isononyl and isodecyl isomer mixtures, and also undecyl or dodecyl.

In addition, it is also possible to use for example tridecyl, the isotridecyl isomer mixture, tetradecyl, pentadecyl, hexadecyl, heptadecyl, octadecyl, nonadecyl or icosyl.

Any alkyl may also be substituted by phenyl; specific examples, where Ph=phenyl, are:

$-CH_2-Ph$, $-CH(CH_3)-Ph$, $-(CH_2)_2-Ph$,
$-(CH_2)_4-CH(CH_3)-Ph-3-CH_3$,
$-(CH_2)_3-CH(C_4H_9)-Ph-3-C_4H_9$,
$-(CH_2)_6-Ph-4-O-CH_3$,
$-CH(C_2H_5)-(CH_2)_3-Ph-3-O-C_2H_5$ and
$-CH(C_2H_5)-(CH_2)_3-Ph-3-Cl$.

When $R^1$ or $R^2$ is alkoxyalkyl of the preferred formula II, suitable W is for example 1,2- or 1,3-propylene, 1,2-, 1,3-, 1,4- or 2,3-butylene, pentamethylene, hexamethylene or 2-methylpentamethylene, in particular ethylene, $R^4$ is in particular methyl, ethyl, propyl, butyl or phenyl which may be substituted by methyl(oxy), ethyl(oxy), propyl(oxy) or butyl(oxy). Particularly preferred groups II are for example:

$-(CH_2)_2-O-CH_3$, $-(CH_2)_2-O-C_2H_5$, $-(CH_2)_2-O-C_3H_7$, $-(CH_2)_2-O-C_4H_9$, $-(CH_2)_2-O-Ph$, $-(CH_2)_2-O-CH_2-Ph$,
$-[(CH_2)_2-O]_2-CH_3$, $-[(CH_2)_2-O]_2-Ph$, $-[(CH_2)_2-O]_2-Ph-4-O-C_4H_9$,
$-[(CH_2)_2-O]_3-C_4H_9$, $-[(CH_2)_2-O]_3-Ph$, $-[(CH_2)_2-O]_3-Ph-3-C_4H_9$,
$-[(CH_2)_2-O]_4-CH_3$ and
$-(CH_2)_3-O-(CH_2)_2-O-Ph$.

Further preferred groups II are for example:

$-(CH_2)_3-O-CH_3$, $-(CH_2)_3-O-C_2H_5$, $-(CH_2)_3-O-C_3H_7$, $-(CH_2)_3-O-C_4H_9$,
$-(CH_2)_3-O-Ph$,
$-CH_2-CH(CH_3)-O-CH_3$, $-CH_2-CH(CH_3)-O-C_2H_5$, $-CH_2-CH(CH_3)-O-C_3H_7$, $-CH_2-CH(CH_3)-O-C_4H_9$, $-CH_2-CH(CH_3)-O-Ph$, $-(CH_2)_4-O-CH_3$, $-(CH_{24}-O-C_2H_5$, $-(CH_2)_4-O-C_{45}H_9$, $-(CH_2)_4-O-Ph$,
$-(CH_2)_4-O-CH_2-Ph-2-O-C_2H_5$, $-(CH_2)_4-O-C_6H_{10}-2-C_2H_5$,
$-[(CH_2)_4-O]_2-C_2H_5$, $-[(CH_2)_2-CH(CH_3)-O]_2-C_2H_5$,
$-(CH_2)_5-O-CH_3$, $-(CH_2)_5-O-C_2H_5$, $-(CH_2)_5-O-C_3H_7$, $-(CH_2)_5-O-Ph$,
$-(CH_2)_2-CH(C_2H_5)-O-CH_2-Ph-3-O-C_4H_9$, $-(CH_2)_2-CH(C_2H_5)-O-CH_2-Ph-3-Cl$,
$-(CH_2)_6-O-C_4H_9$, $-(CH_2)_6-O-Ph-4-O-C_4H_9$ and
$-(CH_2)_3-CH(CH_3)-CH_2-O-C_4H_9$.

In addition, it is also possible to use the following alkoxyalkyl groups:

$-(CH_2)_8-O-CH_3$, $-(CH_2)_8-O-C_4H_9$, $-(CH_2)_8-O-CH_2-Ph-3-C_2H_5$,
$-(CH_2)_4-CH(Cl)-(CH_2)_3-O-CH_2-Ph-3-CH_3$ and
$-(CH_2)_3-CH(C_4H_9)-O-CH_2-Ph-3-CH_3$.

Suitable alkanoyloxyalkyl, alkoxycarbonyloxyalkyl or alkoxycarbonylalkyl $R^1$ or $R^2$ is for example:

$-(CH_2)_2-O-CO-CH_3$,
$-(CH_2)_3-O-CO-(CH_2)_7-CH_3$,
$-(CH_2)_2-O-CO-(CH_2)_3-Ph-2-O-CH_3$,
$-CH(CH_2-Ph-3-CH_3)-O-CO-C_4H_9$ or $-(CH_2)_4-O-CO-(CH_2)_4-CH(C_2H_5)-OH$;
$-(CH_2)_2-O-CO-O-CH_3$,
$-(CH_2)_3-O-CO-O-(CH_2)_7-CH_3$,
$-CH(C_2H_5)-CH_2-O-CO-O-C_4H_9$,
$-(CH_2)_4-O-CO-O-(CH_2)_2-CH(CH_3)-O-Ph-3-CH_3$or $-(CH_2)_5-O-CO-O-(CH_2)_5-CN$;
$-(CH_2)_2-CO-O-CH_3$,
$-(CH_2)_3-CO-O-C_4H_9$,
$-(CH_2)_3-CH(CH_3)-CH_2-CO-O-C_4H_9$,
$-(CH_2)_3-CH(C_4H_9)-CH_2-CO-O-C_2H_5$,
$-(CH_2)_2-CO-O-(CH_2)_5-Ph$,
$-(CH_2)_4-CO-O-(CH_2)_4-Ph-4-C_4H_9$,
$-(CH_2)_3-CO-O-(CH_2)_4-O-Ph-3-O-CH_3$,
$-(CH_2)_2-CH(CH_2OH)-(CH_2)_2-CO-O-C_2H_5$,
$-CH(C_2H_5)-CH_2-CO-O-(CH_2)_4-OH$ or
$-(CH_2)_3-CO-O-(CH_2)_6-CN$.

It is also possible to use for example the following haloalkyl, hydroxyalkyl or cyanoalkyl groups as $R^1$ or $R^2$:

$-(CH_2)_5-Cl$, $-CH(C_4H_9)-(CH_2)_3-Cl$ oder $-(CH_2)_4-CF_3$;
$-(CH_2)_2-CH(CH_3)-OH$, $-(CH_2)_2-CH(C_4H_9)-OH$ oder $-CH(C_2H_5)-(CH_2)_9-OH$;
$-(CH_2)_2-CN$, $-(CH_2)_3-CN$, $-CH_2-CH(CH_3)-CH(C_2H_5)-CN$, $-(CH_2)_6-CH(C_2H_5)-CN$ and
$-(CH_2)_3-CH(CH_3)-(CH_2)_2-CH(CH_3)-CN$.
or Phenyl or cyclohexyl which may be present as $R^1$ or $R^2$ are for example:

$-Ph$, $-Ph-3-CH_3$, $-Ph-4-(CH_2)_{10}-CH_3$, $-Ph-3-(CH_2)_5-CH(CH_3)-CH_3$,
$-PH-4-O-C_4H_9$, $-Ph-4-(CH_2)_5-CH(C_2H_5)-CH_3$, $-Ph-4-O-CH_2-Ph$ and $-Ph-4-Cl$;
$-C_6H_{10}-4-CH_3$, $-C_6H_{10}-4-C_{10}H_{21}$, $-C_6H_{10}-3-O-C_4H_9$,
$-C_6H_{10}-3-O-(CH_2)_4-CH(C_2H_5)-CH_3$ oder $-C_6H_{10}-4-Cl$.

A particularly preferred $R^3$ is methyl, but it is also possible to use ethyl, propyl or isopropyl as well as hydrogen, amino or hydroxyl.

X and Y are each preferably hydrogen or nitro or else chlorine or bromine. Further suitable X is methyl, methyloxy, ethyloxy, propyloxy, butyloxy, phenoxy, tolyloxy or dimethylphenoxy.

Particularly preferred Z is cyano, but it is also possible to use hydrogen, acetyl or carbamoyl.

The dyes I to be used according to the present invention are notable for the following properties compared with the prior art yellow thermotransfer printing dyes: readier thermal transferability despite the relatively high molecular weight, improved migration properties in the receiving medium at room temperature, significantly higher lightfastness, better resistance to moisture and chemicals, better solubility in printing ink preparation, higher color strength, and readier industrial accessibility.

In addition, the azo dyes I exhibit a distinctly better purity of hue, in particular in mixtures of dyes, and produce improved black prints.

The transfer sheets required as dye donors for the thermotransfer printing process according to the present invention are prepared as follows. The azo dyes I are incorporated into a suitable organic solvent, eg. isobutanol, methyl ethyl ketone, methylene chloride, chlorobenzene, toluene, tetrahydrofuran or a mixture thereof, together with one or more binders and possibly further assistants such as release agents or crystallization inhibitors to form a printing ink in which the dyes are preferably present in a molecularly dispersed, ie. dissolved, form. The printing ink is then applied to an inert substrate and dried.

Suitable binders for the use of the azo dyes I according to the present invention are all materials which are soluble in organic solvents and which are known to be suitable for thermotransfer printing, eg. cellulose derivatives such as methylcellulose, hydroxypropylcellulose, cellulose acetate or cellulose acetobutyrate, but in particular ethylcellulose and ethylhydroxyethylcellulose, starch, alginates, alkyd resins and vinyl resins such as polyvinyl alcohol or polyvinylpyrrolidone and also in particular polyvinyl acetate and polyvinyl butyrate. It is also possible to use polymers and copolymers of acrylates or derivatives thereof such as polyacrylic acid, polymethyl methacrylate and styrene-acrylate copolymers, polyester resins, polyamide resins, polyurethane resins or natural resins such as gum arabic.

It is frequently advisable to use mixtures of these binders, for example mixtures of ethylcellulose and polyvinyl butyrate in a weight ratio of 2:1.

The weight ratio of binder to dye is in general from 8:1 to 1:1, preferably from 5:1 to 2:1.

Suitable assistants are for example release agents based on perfluorinated alkylsulfonamidoalkyl esters or silicones, as described in EP-A-227 092 and EP-A-192 435, and in particular organic additives which stop the transfer dyes from crystallizing out in the course of storage or heating of the inked ribbon, for example cholesterol or vanillin.

Inert substrate materials are for example tissue, blotting or parchment paper and films made of heat resistant plastics such as polyesters, polyamides or polyimides, which films may also be metal coated.

The inert substrate may additionally be coated on the side facing the thermal printing head with a lubricant in order that adhesion of the thermal printing head to the substrate material may be prevented. Suitable lubricants are for example silicones or polyurethanes as described in EP-A-216 483.

The thickness of the dye transfer is in general from 3 to 30 μm, preferably from 5 to 10 μm.

The receiving medium to be printed, eg. paper, must in turn be coated with a binder which receives the dye during the printing process. It is preferable to use for this purpose polymeric materials whose glass transition temperatures $T_g$ are within the range from 50° to 100° C., eg. polycarbonates and polyesters. Details may be found in EP-A-227 094, EP-A-133 012, EP-A-133 011, JP-A-199 997/1986 or JP-A-283 595/1986.

EXAMPLES

First, transfer sheets (donors) were prepared in a conventional manner from a polyester sheet 8 μm in thickness coated with an approximately 5 μm thick transfer layer of binder B which in each case contained 0.25 g of azo dye I. The weight ratio of binder to dye was in each case 4:1.

The receiving medium to be printed (receiver) was paper about 120 μm in thickness which had been coated with a layer of plastic 8 μm in thickness (Hitachi Color Video Print Paper).

Donor and receiver were placed on top of one another with the coated fronts next to each other, then wrapped in aluminum foil and heated between two hot-plates at 70°-80° C. for 2 minutes. This operation was repeated three times with similar samples at a temperature within the range from 80° to 120° C., the temperature being increased each time.

The amount of dye diffusing into the plastics layer of the receiver in the course of transfer is proportional to the optical density determined photometrically as absorbance A after each heating phase at the abovementioned temperatures.

A plot of the logarithm of the measured absorbances A against the corresponding reciprocal of the absolute temperature is a straight line from whose slope it is possible to calculate the activation energy $\Delta E_T$ for the transfer experiment:

$$\Delta E_T = 2.3 \times R \times \frac{\Delta \log A}{\Delta [1/T]} \quad R\text{: general gas constant}$$

It is additionally possible to infer from the plot the temperature T* at which the absorbance attains the value 1, ie. at which the transmitted light intensity is one tenth of the incident light intensity. The lower the temperature T*, the better the thermal transferability of the particular dye.

The tables which follow divide the azo dyes I used into groups; the variable P indicates the position of the oxadiazole radical on the phenyl ring of the diazo component in relation to the azo group (o: ortho, m: meta, p: para).

In addition, they list the particular binder B used employing the following abbreviations: EC=ethylcellulose, PVB=polyvinyl butyrate, MIX=EC:PVB=2:1.

Further characteristic data are the absorption maxima $\lambda_{max}$[nm] measured in methylene chloride and the abovementioned parameters T8[° C.] and $\Delta E_T$[kcal/mol].

TABLE 1

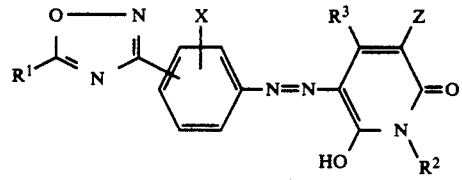

| Example | P | $R^1$ | $R^2$ | $R^3$ | X | Z | B | $\lambda_{max}$ [nm] | T*[°C.] | $\Delta E_T$ [kcal/mol] |
|---|---|---|---|---|---|---|---|---|---|---|
| 1 | p | $-(CH_2)_{10}-CH_3$ | —H | $-CH_3$ | —H | —CN | EC | 443 | 115 | 17 |
| | | | | | | | MIX | | 114 | 21 |

TABLE 1-continued

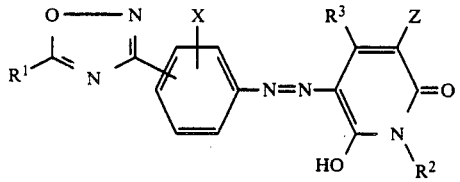

| Example | P | $R^1$ | $R^2$ | $R^3$ | X | Z | B | $\lambda_{max}$ [nm] | T*[°C.] | $\Delta E_T$ [kcal/mol] |
|---|---|---|---|---|---|---|---|---|---|---|
| 2 | p | $-(CH_2)_{14}-CH_3$ | $-H$ | $-CH_3$ | $-H$ | $-CN$ | EC | 444 | 110 | 19 |
| | | | | | | | MIX | | 107 | 22 |
| 3 | m | $-CH(C_2H_5)-C_4H_9$ | $-H$ | $-CH(CH_3)-CH_3$ | $-H$ | $-CO-CH_3$ | EC | 424 | 102 | 15 |
| 4 | p | $-CH(C_2H_5)-C_4H_9$ | $-H$ | $-CH_3$ | o-$NO_2$ | $-CO-CH_3$ | MIX | 441 | 108 | 15 |
| | | | | | | | EC | | 127 | 12 |
| 5 | p | $-CH(C_2H_5)-C_4H_9$ | $-H$ | $-CH_3$ | $-H$ | $-CO-CH_3$ | MIX | 434 | 101 | 18 |
| 6 | p | $-CH_3$ | $-(CH_2)_5-CH_3$ | $-NH_2$ | $-H$ | $-CN$ | EC* | 429 | 125 | 16 |
| | | | | | | | MIX | | 110 | 15 |
| 7 | p | $-CH(C_2H_5)-C_4H_9$ | $-C_4H_9$ | $-CH_3$ | o-$NH_2$ | $-H$ | EC | 437 | 112 | 13 |
| | | | | | | | MIX | | 99 | 15 |

*Weight ratio of binder to dye = 5:1

TABLE 2

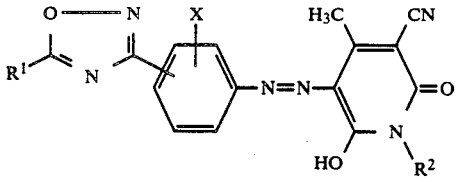

| Example | P | $R^1$ | $R^2$ | X | B | B:F | λmax [nm] | T* [°C.] | $\Delta E_T$ [kcal/mol] |
|---|---|---|---|---|---|---|---|---|---|
| 8 | m | $-(CH_2)_2-CO_2-C_2H_5$ | $-CH_3$ | $-H$ | EC | | 430 | 111 | 14 |
| 9 | m | $-(CH_2)_6-CH_3$ | $-CH_3$ | $-H$ | EC | | 430 | 88 | 9 |
| 10 | p | $-(CH_2)_2-CO-O-CH_3$ | $-C_2H_5$ | $-H$ | EC | | 441 | 125 | 21 |
| 11 | p | $-CH(C_2H_5)-C_4H_9$ | $-C_2H_5$ | $-H$ | EC | | 442 | 98 | 11 |
| 12 | m | $-(CH_2)_2-CO-O-C_2H_5$ | $-C_2H_5$ | $-H$ | EC | | 430 | 102 | 11 |
| 13 | p | $-CH(C_2H_5)-C_4H_9$ | $-C_2H_5$ | o-$NO_2$ | EC | | 446 | 106 | 14 |
| 14 | p | $-(CH_2)_{14}-CH_3$ | $-(CH_2)_2-OH$ | $-H$ | MIX | | 443 | 110 | 18 |
| 15 | p | $-CH(C_2H_5)-C_4H_9$ | $-C_3H_7$ | $-H$ | EC | | 432 | 126 | 13 |
| | | | | | MIX | | | 113 | 13 |
| 16 | m | $-CH_2-O-Ph$ | $-CH(CH_3)-CH_3$ | $-H$ | EC | | 428 | 127 | 11 |
| 17 | p | $-(CH_2)_{14}-CH_3$ | $-C_4H_9$ | $-H$ | EC | | 441 | 93 | 19 |
| 18 | p | $-CH(C_2H_5)-C_4H_9$ | $-C_4H_9$ | $-H$ | EC | | 441 | 117 | 22 |
| 19 | p | $-(CH_2)_6-CH_3$ | $-C_4H_9$ | $-H$ | EC | | 441 | 98 | 17 |
| 20 | m | $-CH_2-O-Ph$ | $-C_4H_9$ | $-H$ | EC | | 430 | 139 | 9 |
| 21 | p | $-CH(C_2H_5)-C_4H_9$ | $-C_4H_9$ | $-H$ | EC | | 442 | 104 | 14 |
| 22 | p | $-CH(C_2H_5)-C_4H_9$ | $-C_4H_9$ | o-Br | EC | | 421 | 106 | 16 |
| 23 | p | $-(CH_2)_{14}-CH_3$ | $-(CH_2)_4-OH$ | $-H$ | MIX | | 442 | 99 | 13 |
| 24 | m | $-(CH_2)_2-CO-O-C_2H_5$ | $-(CH_2)_3-O-CH_3$ | $-H$ | EC | | 430 | 99 | 10 |
| 25 | m | $-(CH_2)_2-CO-O-C_2H_5$ | $-(CH_2)_2-O-CH_3$ | $-H$ | EC | | 430 | 104 | 13 |
| | | | | | MIX | | | 84 | 16 |
| 26 | m | $-C_2H_5$ | $-(CH_2)_3-O-CH_2-Ph$ | $-H$ | EC | 4:1 | 430 | 98 | 16 |
| 27 | m | $-CH_3$ | $-(CH_2)_3-O-CH_2-Ph$ | $-H$ | EC | 4:1 | 430 | 99 | 9 |
| 28 | p | $-CH_3$ | $-(CH_2)_3-O-(CH_2)_4-O-CO-CH_3$ | $-H$ | EC | 4:1 | 440 | 100 | 11 |
| | | | | | MIX | 4:1 | | 88 | 17 |
| 29 | m | $-CH_3$ | $-(CH_2)_3-O-(CH_2)_4-O-CO-CH_3$ | $-H$ | EC | 4:1 | 430 | 100 | 9 |
| | | | | | MIX | 4:1 | | 79 | 19 |
| 30 | m | $-CH_3$ | $-(CH_2)_3-O-C(CH_3)_2-(CH_2)_2-O-CH_3$ | $-H$ | EC | 4:1 | 430 | 100 | 20 |
| 31 | p | $-CH_3$ | $-(CH_2)_5-CH_3$ | $-H$ | EC | 4:1 | 441 | 112 | 13 |

We claim:

1. A process for transferring an azo dye by diffusion from a transfer to a plastic-coated receiving medium with the aid of a thermal printing head, which comprises using for this purpose a transfer on which there is or are situated one or more azo dyes of the formula I

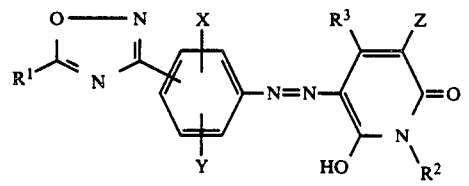

I in which the substituents have the following meanings:

$R^1$ and $R^2$ are each hydrogen;

alkyl, alkoxyalkyl, alkanoyloxyalkyl, alkoxycarbonyloxyalkyl, alkoxycarbonylalkyl, haloalkyl, hydroxyalkyl or cyanoalkyl, which may each contain up to 20 carbon atoms and be substituted by phenyl, $C_1$–$C_4$ alkylbenzyloxy, $C_1$–$C_4$-alkoxybenzyloxy, $C_1$–$C_4$ alkylphenyl, $C_1$–$C_4$ alkoxyphenyl, halophenyl, benzyloxy, $C_1$–$C_4$ alkylbenzyloxy, $C_1$–$C_4$-alkoxybenzyloxy, halobenzyloxy, halogen, hydroxyl or cyano;

phenyl or cyclohexyl, which may each be substituted by $C_1$–$C_{15}$-alkyl, $C_1$–$C_{15}$-alkoxy, halogen or benzyloxy; or a radical of the general formula II:

$$[-W-O]_n-R^4 \qquad \text{II}$$

where

W is identical or different $C_2$–$C_6$-alkylene, n is from 1 to 6 and $R^4$ is $C_1$–$C_4$-alkyl or phenyl which may each be substituted by $C_1$–$C_4$-alkyl or $C_1$–$C_4$-alkoxy;

$R^3$ is hydrogen, amino, hydroxyl or alkyl;

X is hydrogen chlorine, bromine, nitro, methyl, phenoxy, tolyloxy, dimethylphenyloxy, chlorophenoxy or $C_1$–$C_4$-alkoxy;

Y is hydrogen, chlorine or bromine; and is hydrogen, acetyl, carbamoyl or cyano.

2. A process as claimed in claim 1, wherein the azo dye used has the formula Ia

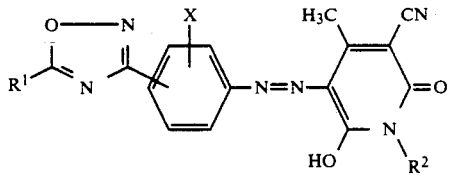

Ia

3. A process as claimed in claim 1, wherein the azo dye used has the formula Ib

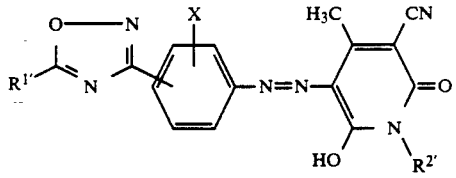

Ib in which the variables have the following meanings:

$R^{1'}$ and $R^{2'}$ are each:

hydrogen;

alkyl, alkoxyalkyl, alkanoyloxy or alkoxycarbonylalkyl, which may each contain up to 15 carbon atoms and be substituted by phenyl, $C_1$–$C_4$-alkylphenyl, $C_1$–$C_4$-alkoxyphenyl, hydroxyl or cyano; or a radical of the general formula III $$[-(CH_2)_3-O]_p-[(CH_2)_2-O]_q-R^{4'} \qquad \text{III}$$

where p is 0 or 1, q is from 1 to 4, and $R^{4'}$ is $C_1$–$C_4$-alkyl or phenyl.

4. The process of claim 1, wherein said the plastic of said plastic-coated receiving medium is selected from the group consisting of polycarbonates and polyesters or a mixture thereof.

* * * * *